US010598118B2

(12) United States Patent
Nakaoka

(10) Patent No.: US 10,598,118 B2
(45) Date of Patent: Mar. 24, 2020

(54) HIGH-PRESSURE PUMP AND FUEL-SUPPLY SYSTEM USING SAME

(71) Applicant: DENSO CORPORATION, Kariya, Aichi-pref. (JP)

(72) Inventor: Masaharu Nakaoka, Kariya (JP)

(73) Assignee: DENSO CORPORATION, Kariya (JP)

( * ) Notice: Subject to any disclaimer, the term of this patent is extended or adjusted under 35 U.S.C. 154(b) by 287 days.

(21) Appl. No.: 15/518,310

(22) PCT Filed: Nov. 26, 2015

(86) PCT No.: PCT/JP2015/005870
§ 371 (c)(1),
(2) Date: Apr. 11, 2017

(87) PCT Pub. No.: WO2016/088339
PCT Pub. Date: Jun. 9, 2016

(65) Prior Publication Data

US 2017/0306880 A1 Oct. 26, 2017

(30) Foreign Application Priority Data

Dec. 5, 2014 (JP) ..... 2014-246992

(51) Int. Cl.
*F02D 41/38* (2006.01)
*F02M 59/44* (2006.01)
(Continued)

(52) U.S. Cl.
CPC ..... *F02D 41/3836* (2013.01); *F02M 55/02* (2013.01); *F02M 59/366* (2013.01);
(Continued)

(58) Field of Classification Search
CPC ..... F02D 41/03836; F02D 41/00; F02D 2200/0602; F02M 55/02; F02M 59/366;
(Continued)

(56) References Cited

U.S. PATENT DOCUMENTS 5,040,511 A * 8/1991 Eckert ..... F02M 59/102 123/446
6,062,831 A * 5/2000 Konishi ..... F02M 55/04 417/540

(Continued)

FOREIGN PATENT DOCUMENTS

JP 2013-36431 2/2013

*Primary Examiner* — Phutthiwat Wongwian
*Assistant Examiner* — Susan E Scharpf
(74) *Attorney, Agent, or Firm* — Nixon & Vanderhye P.C.

(57) ABSTRACT

A high-pressure pump includes: a low-pressure chamber, into which low-pressure fuel discharged from a low-pressure pump flows; a pressurizing chamber, which pressurizes the low-low-pressure fuel; and a leak chamber, into which leaked fuel from the pressurizing chamber flows. The leaked fuel of the leak chamber is suctioned into and is pressurized in the pressurizing chamber together with the low-pressure fuel of the low-pressure chamber, so that the leaked fuel is discharged to an outside of the high-pressure pump as high-pressure fuel. Furthermore, a suction check valve, which is placed between the low-pressure chamber and the leak chamber, limits backflow of the leaked fuel of the leak chamber to the low-pressure chamber when the high-pressure pump does not supply the high-pressure fuel.

8 Claims, 5 Drawing Sheets

(51) Int. Cl.

| | |
|---|---|
| ***F02M 59/36*** | (2006.01) |
| ***F02M 63/02*** | (2006.01) |
| ***F02M 55/02*** | (2006.01) |
| ***F02D 41/00*** | (2006.01) |
| ***F02M 63/00*** | (2006.01) |

(52) U.S. Cl.
CPC ..... *F02M 59/367* (2013.01); *F02M 59/442* (2013.01); *F02M 63/02* (2013.01); *F02M 63/029* (2013.01); *F02D 41/00* (2013.01); *F02D 2200/0602* (2013.01); *F02M 63/00* (2013.01)

(58) Field of Classification Search
CPC .... F02M 59/367; F02M 59/442; F02M 59/63; F02M 59/02; F02M 63/029; F02M 63/00; Y10T 137/87917; Y10T 137/88054
USPC ..... 123/446; 137/613, 614.2
See application file for complete search history.

(56) References Cited

U.S. PATENT DOCUMENTS 6,363,914 B1 * 4/2002 Tanabe ..... F02D 41/3827 123/447
2003/0017069 A1 * 1/2003 Usui ..... F02M 59/102 417/571
2003/0154959 A1 * 8/2003 Rembold ..... F02D 33/006 123/458
2005/0115543 A1 * 6/2005 Rembold ..... F02M 59/34 123/446
2007/0110603 A1 * 5/2007 Usui ..... F02M 63/005 417/505
2008/0213112 A1 * 9/2008 Lucas ..... F02M 59/02 417/471
2009/0165752 A1 * 7/2009 Yonemoto ..... F02M 37/0023 123/506
2009/0288639 A1 * 11/2009 Usui ..... F02M 55/04 123/457
2010/0111734 A1 * 5/2010 Usui ..... F02M 59/366 417/505
2011/0253109 A1 * 10/2011 Usui ..... F02M 39/02 123/509
2012/0180649 A1 * 7/2012 Hishinuma ..... F04B 1/0452 91/435
2012/0312278 A1 * 12/2012 Usui ..... F02M 59/462 123/446
2013/0118449 A1 * 5/2013 Marriott ..... F02M 43/02 123/304
2013/0151052 A1 * 6/2013 Fukuzawa ..... B60W 10/06 701/22
2014/0199194 A1 * 7/2014 Usui ..... F02M 63/005 417/510
2014/0216418 A1 * 8/2014 Asayama ..... F02M 59/44 123/495

* cited by examiner

HIGH-PRESSURE PUMP AND FUEL-SUPPLY SYSTEM USING SAME

CROSS REFERENCE TO RELATED APPLICATION

This application is the U.S. national phase of International Application No. PCT/JP2015/005870 filed on Nov. 26, 2015 which designated the U.S. and claims priority to Japanese Patent Application No. 2014-246992 filed on Dec. 5, 2014, the entire contents of each of which are hereby incorporated by reference.

TECHNICAL FIELD

The present disclosure relates to a high-pressure pump and a fuel-supply system using the same.

BACKGROUND ART

Previously, there is known a fuel-supply system that can supply fuel of different pressures to an internal combustion engine. For example, the patent literature 1 recites a fuel-supply system that includes: a low-pressure pump that pressurizes fuel of a fuel tank to a relatively low pressure and discharges the pressurized fuel; a high-pressure pump that pressurizes the fuel pressurized by the low-pressure pump to a relatively high pressure and discharges the pressurized fuel; a low-pressure fuel injection valve that injects the low-pressure fuel discharged from the low-pressure pump; and a high-pressure fuel injection valve that injects the high-pressure fuel discharged from the high-pressure pump.

In general, in the high-pressure pump, a portion of fuel of a pressurizing chamber leaks from the pressurizing chamber as leaked fuel through a gap between an inner wall of a housing of the high-pressure pump, which slidably contacts a plunger, and an outer wall of the plunger. The leaked fuel, which is the fuel leaked from the pressurizing chamber, is the pressurized fuel that is pressurized to the relatively high pressure. Therefore, when the leaked fuel leaks into a space having a relatively low pressure, the temperature of the leaked fuel becomes high. When this leaked fuel stays in this space for a relatively long period of time, the temperature of the high-pressure pump becomes high. Therefore, the fuel in the gap between the inner wall of the housing and the outer wall of the plunger may possibly be evaporated to form fuel vapor. Normally, smooth slide movement between the housing and the plunger is maintained when the fuel in the gap is in a form of liquid. However, when the fuel in the gap is evaporated to form the fuel vapor, the smooth slide movement between the housing and the plunger becomes difficult. Therefore, seizing may possibly occur between the inner wall of the housing and the outer wall of the plunger to possibly cause a damage of the high-pressure pump.

A method of directly returning the leaked fuel to the fuel tank is conceivable. However, there are some disadvantages, such as an increase in the number of pipes for returning the leaked fuel and a difficulty of providing a space for installing these pipes depending on an install location of the high-pressure pump.

In the fuel-supply system of the patent literature 1, the fuel, which is discharged from the low-pressure pump, is once stored in a low-pressure chamber in the high-pressure pump, and then a portion of this stored fuel in the low-pressure chamber is supplied to the low-pressure fuel injection valve. At this time, due to the reciprocation of the plunger, a portion of the leaked fuel flows into the low-pressure chamber. Therefore, the portion of the leaked fuel can be discharged to the outside of the high-pressure pump. However, all of the leaked fuel cannot be discharged to the outside of the high-pressure pump, so that there is a possibility of that the temperature of the high-pressure pump is increased. Thereby, there is a possibility of that the seizing occurs between the inner wall of the housing and the outer wall of the plunger.

Furthermore, the patent literature 1 recites an embodiment where the fuel discharged from the low-pressure pump is first introduced into the leak chamber, and thereafter a portion of this fuel is supplied to the low-pressure fuel injection valve. In this way, all of the leaked fuel of the leak chamber is discharged to the outside of the high-pressure pump. However, the temperature and the pressure of the fuel supplied to the low-pressure fuel injection valve may be changed by the temperature and the pressure of the leaked fuel. Therefore, there is a possibility of that injection characteristics of the low-pressure fuel injection valve are changed.

CITATION LIST

Patent Literature

PATENT LITERATURE 1: JP5401360B2 (corresponding to US2012/0312278A1)

SUMMARY OF INVENTION

It is an objective of the present disclosure to provide a high-pressure pump that can limit seizing of a plunger. It is another objective of the present disclosure to provide a fuel-supply system that includes the above high-pressure pump.

There is provided a high-pressure pump that suctions fuel of a fuel tank and discharges the suctioned fuel after pressurizing the suctioned fuel to a pressure that is injectable by a high-pressure injection valve while the high-pressure pump includes a plunger, a pressurizing portion, a leak fuel inflow portion, a suction control valve, a discharge valve, an inlet portion, an outlet portion and a suction check valve.

The pressurizing portion reciprocatably receives the plunger and includes a pressurizing chamber, in which fuel is pressurized by the plunger.

The leak fuel inflow portion includes a leak chamber, into which the fuel leaked from the pressurizing chamber flows through a gap between the plunger and the pressurizing portion.

The suction control valve includes a suction flow passage, which communicates between the leak chamber and the pressurizing chamber. The suction control valve is operable to control a quantity of the fuel, which is suctioned into the pressurizing chamber through the suction flow passage.

The suction check valve is located between an inlet portion and the leak fuel inflow portion while the inlet portion includes an inlet port, through which fuel of a fuel tank is guided into the leak chamber.

The high-pressure pump of the present disclosure is operable to enable flow of the fuel from the inlet port side to the leak chamber side and block flow of the fuel from the leak chamber side to the inlet port side.

In the high-pressure pump of the present disclosure, the fuel of the fuel tank is suctioned into the pressurizing chamber through the inlet port, the leak chamber and the suction flow passage. The fuel, which is suctioned into the pressurizing chamber, is pressurized by the plunger and is discharged to an outside of the high-pressure pump. Thereby, when the high-pressure pump discharges the fuel of the high-pressure, the leaked fuel in the leak chamber is reliably discharged to the outside of the high-pressure pump through the suction flow passage, the pressurizing chamber and the outlet port together with the fuel of the fuel tank, which is introduced from the inlet port. In this way, it is possible to limit an increase of the temperature of the high-pressure pump, which is caused by long stay of the leaked fuel having the high temperature in the leak chamber, and thereby it is possible to limit evaporation of the fuel that is located between an inner wall of the pressurizing portion, which slides along an outer wall of the plunger, and the outer wall of the plunger.

Furthermore, the fuel stays in the leak chamber, the suction flow passage and the pressurizing chamber when the high-pressure pump is not discharging the fuel of the high pressure, i.e., when the discharging of the leaked fuel is not executed. When the temperature of the high-pressure pump is increased by the environment, in which the high-pressure pump is placed, the temperature of the fuel, which stays in the leak chamber, is increased. In the high-pressure pump of the present disclosure, the fuel can be supplied from the inlet port to the leak chamber by the suction check valve, but the fuel cannot be returned from the leak chamber to the inlet port. Therefore, the pressure of the fuel in the leak chamber is not excessively reduced, and thereby the fuel in, for example, the leak chamber is not evaporated. In this way, it is possible to limit the evaporation of the fuel, which is located in the gap between the inner wall of the pressurizing portion and the outer wall of the plunger, by the temperature increase of the high-pressure pump when the high-pressure pump is not discharging the fuel of the high pressure.

As discussed above, in the high-pressure pump of the present disclosure, the evaporation of the fuel, which is located in the gap between the inner wall of the pressurizing portion and the outer wall of the plunger, is limited regardless of whether the high-pressure pump is discharging the fuel of the high pressure. Thus, the smooth slide movement between the pressurizing portion and the plunger is ensured, and thereby the seizing of the plunger can be limited.

Furthermore, according to the present disclosure, there is provided a fuel-supply system for sullying fuel stored in the fuel tank to an internal combustion engine at a low pressure or a high pressure depending on an operational state of a vehicle, the fuel-supply system including: a low-pressure pump that is operable to suction the fuel of the fuel tank and discharge the suctioned fuel; a low-pressure fuel supply device that supplies the fuel, which is discharged from the low-pressure pump, to the internal combustion engine; the high-pressure pump that is operable to pressurize and discharge the fuel, which is discharged from the low-pressure pump; and a high-pressure fuel supply device that supplies the fuel, which is discharged from the high-pressure pump, to the internal combustion engine.

DESCRIPTION OF EMBODIMENTS

Hereinafter, various embodiments of the present disclosure will be described with reference to the drawings.

First Embodiment

Figure 1:
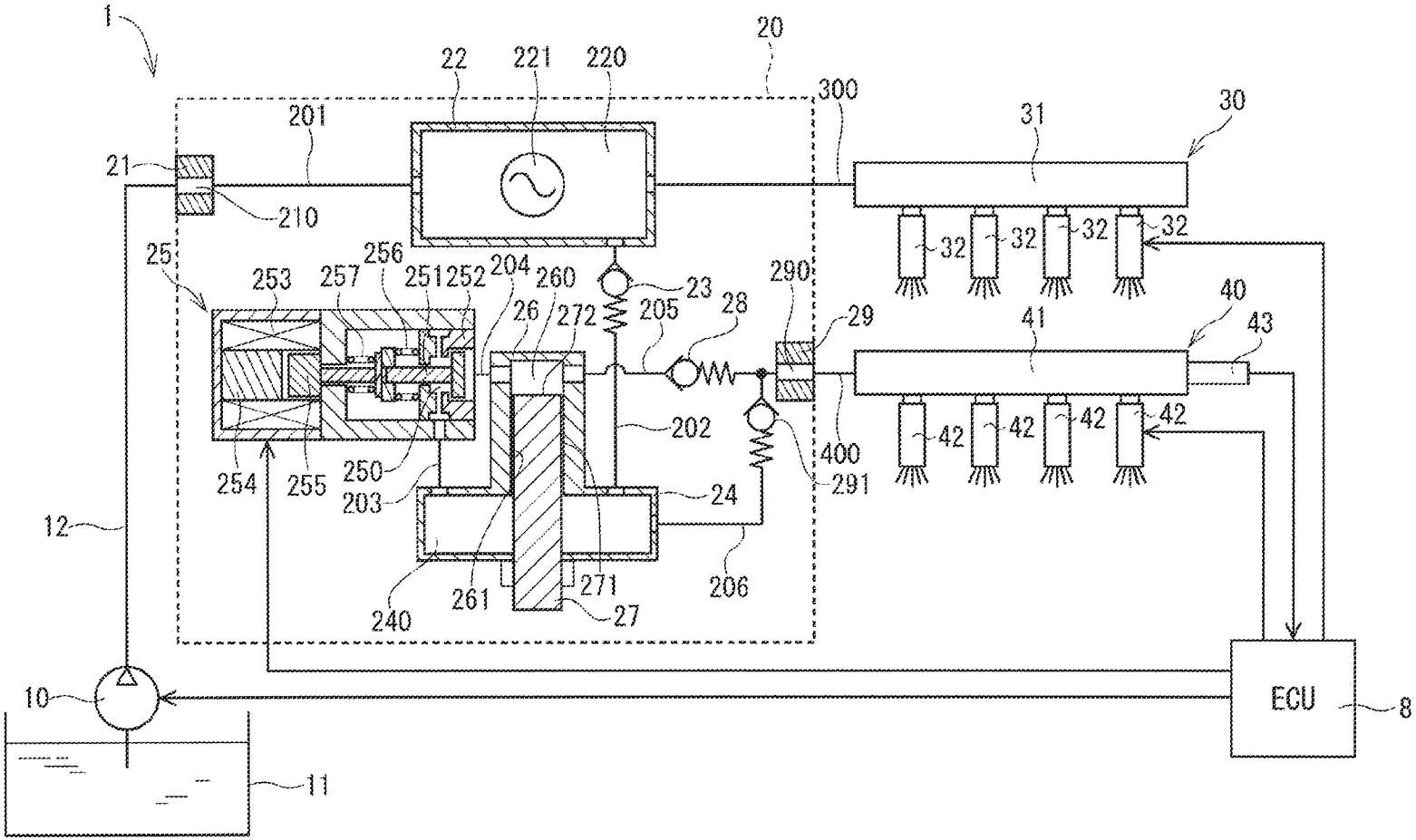
FIG. 1 is a schematic diagram of a fuel-supply system according to a first embodiment of the present disclosure.

A fuel-supply system according to a first embodiment of the present disclosure will be described with reference to FIG. 1. The fuel-supply system 1 is a system that supplies fuel of one pressure and fuel of another pressure to an engine of a vehicle according to an operational state of the vehicle. The fuel-supply system 1 includes a low-pressure pump 10, a high-pressure pump 20, a low-pressure fuel supply device 30 serving as a low-pressure fuel supply device (low-pressure fuel supply means), a high-pressure fuel supply device 40 serving as a high-pressure fuel supply device (high-pressure fuel supply means), and a control device 8.

The low-pressure pump 10 is installed in an inside of a fuel tank 11 that stores fuel. The low-pressure pump 10 is connected to the high-pressure pump 20 through a fuel pipe 12 made of, for example, rubber. The low-pressure pump 10 pressurizes the fuel suctioned from the fuel tank 11 and discharges the pressurized fuel toward the high-pressure pump 20.

The high-pressure pump 20 pressurizes the fuel, which is discharged from the low-pressure pump 10, to a pressure that can be supplied from the high-pressure fuel supply device 40 to the engine. The high-pressure pump 20 includes an inlet portion 21, a low-pressure portion 22, a suction check valve 23, a leak fuel inflow portion 24, a fuel pressure control valve (serving as a suction control valve) 25, a pressurizing portion 26, a plunger 27, a discharge valve 28, an outlet portion 29, and a relief valve 291.

The inlet portion 21 is connected to the fuel pipe 12. The inlet portion 21 has an inlet port 210. The low-pressure fuel, which is discharged from the low-pressure pump 10 and has a relatively low pressure, is introduced into an inside of the high-pressure pump 20 through the inlet port 210. The inlet portion 21 is connected to the low-pressure portion 22 through a first connection pipe 201.

The low-pressure portion 22 is connected to the low-pressure fuel supply device 30 through a low-pressure fuel pipe 300 and is also connected to the leak fuel inflow portion 24 through a second connection pipe 202. The low-pressure portion 22 includes a low-pressure chamber 220 that temporarily stores the low-pressure fuel, which is introduced into the inside of the high-pressure pump 20 through the inlet port 210. The low-pressure chamber 220 is communicated with an inside of the low-pressure fuel supply device 30 and a leak chamber 240 of the leak fuel inflow portion 24. A low-pressure chamber pulsation damper 221 is installed in the low-pressure chamber 220. The low-pressure chamber pulsation damper 221 reduces pressure pulsation of the fuel in the low-pressure chamber 220.

The suction check valve 23 is installed in the second connection pipe 202. The suction check valve 23 enables a flow of the fuel from the low-pressure chamber 220 side to the leak chamber 240 side at a pressure that is equal to or larger than a predetermined valve opening pressure of the suction check valve 23. In contrast, the suction check valve 23 blocks a flow of the fuel from the leak chamber 240 side to the low-pressure chamber 220 side. In the first embodiment, the valve opening pressure of the suction check valve 23 is set such that a pressure, which is obtained by subtracting the valve opening pressure of the suction check valve 23 from the pressure of the fuel discharged from the low-pressure pump 10, is equal to or larger than a saturated vapor pressure of the fuel.

The leak fuel inflow portion 24 is connected to the fuel pressure control valve 25 through a third connection pipe 203. The leak chamber 240 of the leak fuel inflow portion 24 is communicated with a suction flow passage 250 of the fuel pressure control valve 25. Leaked fuel, which is leaked form a pressurizing chamber 260 of the pressurizing portion 26, flows into the leak chamber 240. Here, the leaked fuel is fuel that is a portion of the fuel, which is pressurized to the high pressure in the pressurizing chamber 260 and flows into the leak chamber 240 through a gap between an outer wall 271 of the plunger 27, which is located at a radially outer side of the plunger 27, and an inner wall 261 of the pressurizing portion 26.

The fuel pressure control valve 25 is an electromagnetic valve and is electrically connected to the control device 8. The fuel pressure control valve 25 includes a valve member 251, a valve seat 252, a coil 253, a stationary core 254 and a movable core 255. The fuel pressure control valve 25 is connected to the pressurizing portion 26 through a fourth connection pipe 204. The fuel pressure control valve 25 includes the suction flow passage 250 that can communicate between the leak chamber 240 and the pressurizing chamber 260.

The valve member 251 is received such that the valve member 251 is reciprocatable in an axial direction of a central axis of the fuel pressure control valve 25. The valve member 251 is urged by a first spring 256 against the valve seat 252.

The coil 253 is electrically connected to the control device 8. The stationary core 254 is placed on a radially inner side of the coil 253. The movable core 255 is placed on the stationary core 254 side of the valve member 251. The movable core 255 is urged by a second spring 257 in a direction away from the stationary core 254. The second spring 257 is formed such that the urging force of the second spring 257 is larger than the urging force of the first spring 256.

The fuel pressure control valve 25 is opened and closed based on a signal outputted from the control device 8. Specifically, in a case where an electromagnetic attractive force is not generated between the stationary core 254 and the movable core 255 based on the signal outputted from the control device 8, the valve member 251 and the valve seat 252 are spaced from each other, as shown in FIG. 1. In this way, the leak chamber 240 and the pressurizing chamber 260 are communicated with each other through the suction flow passage 250. Furthermore, when the electromagnetic attractive force is generated between the stationary core 254 and the movable core 255 based on the signal outputted from the control device 8, the valve member 251 and the valve seat 252 contact with each other. Thereby, the communication between the leak chamber 240 and the pressurizing chamber 260 is blocked.

The pressurizing portion 26 is shaped into a generally tubular form having a bottom and receives the plunger 27 in a reciprocatable manner. The pressurizing portion 26 is connected to the outlet portion 29 through a fifth connection pipe 205. The pressurizing portion 26 includes the pressurizing chamber 260, which is formed by an end surface 272 of the plunger 27 and an inner wall of the pressurizing portion 26. The pressurizing chamber 260 is formed such that a volume of the pressurizing chamber 260 can be changed in response to the reciprocation of the plunger 27. When the volume of the pressurizing chamber 260 is decreased in response to upward movement of the plunger 27, the fuel of the pressurizing chamber 260 is pressurized to become the high-pressure fuel, which is the fuel having the relatively high pressure. The pressurizing chamber 260 is communicated with the leak chamber 240 through the gap between the outer wall 271 of the plunger 27 and the inner wall 261 of the pressurizing portion 26.

The discharge valve 28 is installed in the fifth connection pipe 205. The discharge valve 28 enables a flow of the fuel from the pressurizing chamber 260 to an outlet port 290 of the outlet portion 29 when the pressure of the pressurizing chamber 260 becomes equal to or larger than a first pressure. In contrast, the discharge valve 28 blocks a flow of the fuel from the outlet port 290 to the pressurizing chamber 260.

The outlet portion 29 is connected to a high-pressure fuel pipe 400. The outlet portion 29 has the outlet port 290, through which the high-pressure fuel discharged from the discharge valve 28 is supplied into the high-pressure fuel supply device 40.

The relief valve 291 is installed in a sixth connection pipe 206. One end of the sixth connection pipe 206 is connected to a portion of the fifth connection pipe 205, which is location between the discharge valve 28 and the outlet portion 29. The other end of the sixth connection pipe 206 is connected to the leak fuel inflow portion 24. The relief valve 291 is opened when a pressure of the fuel in a portion of the fifth connection pipe 205, which is located between the discharge valve 28 and the outlet portion 29, becomes equal to or larger than a second pressure, which is larger than the first pressure, to return the fuel, which is located on the downstream side of the discharge valve 28, to the leak chamber 240.

The low-pressure fuel supply device 30 includes a low-pressure rail 31 and a plurality of low-pressure fuel injection valves 32.

The low-pressure rail 31 is connected to the low-pressure portion 22 through the low-pressure fuel pipe 300. The low-pressure rail 31 temporarily stores the low-pressure fuel, which is supplied from the low-pressure chamber 220 through the low-pressure fuel pipe 300.

Each of the low-pressure fuel injection valves 32 is connected to the low-pressure rail 31. Each low-pressure fuel injection valve 32 is electrically connected to the control device 8 and injects the low-pressure fuel, which is stored in the low-pressure rail 31, according to a command received from the control device 8.

The high-pressure fuel supply device 40 includes a high-pressure rail 41, a plurality of high-pressure fuel injection valves 42 and a pressure sensor 43.

The high-pressure rail 41 is connected to the outlet portion 29 through the high-pressure fuel pipe 400. The high-pressure rail 41 temporarily stores the high-pressure fuel, which is supplied from the outlet portion 29 through the high-pressure fuel pipe 400. The pressure sensor 43, which senses the pressure of the fuel in the high-pressure rail 41, is installed to the high-pressure rail 41. The pressure sensor 43 senses the pressure of the fuel in the high-pressure rail 41 and outputs the sensed pressure to the control device 8.

Each of the high-pressure fuel injection valves 42 is connected to the high-pressure rail 41. Each high-pressure fuel injection valve 42 can supply the fuel, which has the pressure of, for example, 80 MPa, to the engine. Each high-pressure fuel injection valve 42 is electrically connected to the control device 8 and injects the high-pressure fuel, which is stored in the high-pressure rail 41, according to a command of the control device 8 that is generated based on, for example, the sensed result of the pressure sensor 43.

The control device 8 includes a microcomputer as its main component. The control device 8 is electrically connected to the low-pressure pump 10, the fuel pressure control valve 25, the low-pressure fuel injection valves 32, the high-pressure fuel injection valves 42 and the pressure sensor 43. The control device 8 controls the operations of the low-pressure pump 10, the fuel pressure control valve 25, the low-pressure fuel injection valves 32, and the high-pressure fuel injection valves 42 according to the driving state of the vehicle, such as the pressure of the fuel in the high-pressure rail 41, an operational state (e.g., a rotational speed) of the engine, and an accelerator opening degree controlled by a driver of the vehicle.

Next, the operation of the fuel-supply system 1 will be described.

The fuel, which is pressurized to the relatively low pressure by the low-pressure pump 10, is introduced into the low-pressure chamber 220 through the fuel pipe 12 and the inlet portion 21. A portion of the fuel in the low-pressure chamber 220 is introduced into the suction flow passage 250 through the second connection pipe 202, the leak fuel inflow portion 24 and the third connection pipe 203.

When the pressure of the pressurizing chamber 260 becomes a depressurized state by downward movement of the plunger 27, the low-pressure fuel of the suction flow passage 250 of the fuel pressure control valve 25, which is placed into a valve opening state, is suctioned into the pressurizing chamber 260. When the control device 8 outputs a valve closing command for dosing the fuel pressure control valve 25 in the middle of returning a portion of the fuel, which has been once suctioned into the pressurizing chamber 260, to the suction flow passage 250 through upward movement of the plunger 27, the movable core 255 is magnetically attracted to the stationary core 254, and thereby the valve member 251 and the valve seat 252 contact with each other. In this way, the communication between the suction flow passage 250 and the pressurizing chamber 260 is blocked, and thereby the amount of fuel, which is pressurized in the pressurizing chamber 260, is determined. Thereafter, the plunger 27 is further upwardly moved, and thereby the fuel in the pressurizing chamber 260 is pressurized.

When the fuel is pressurized in the pressurizing chamber 260, a portion of the high-pressure fuel in the pressurizing chamber 260 flows into the leak chamber 240 through the gap between the outer wall 271 of the plunger 27 and the inner wall 261 of the pressurizing portion 26. The temperature of the leaked fuel, which is supplied into the leak chamber 240, is increased since the leaked fuel is moved to the leak chamber 240, which has the pressure that is smaller than the pressure of the pressurizing chamber 260. In the first embodiment, in a case where the pressure of the fuel in the pressurizing chamber 260 is 80 MPa, and the pressure of the leak chamber 240 is 0.4 MPa, the temperature of the leaked fuel is increased by about 30 degrees Celsius. The leaked fuel, which is supplied into the leak chamber 240 and has the high temperature, is suctioned once again into the pressurizing chamber 260 along with the low-pressure fuel directed from the low-pressure chamber 220 to the suction flow passage 250, and then this fuel is fed from the pressurizing chamber 260 to the high-pressure fuel supply device 40.

In contrast, in the fuel-supply system 1, a portion of the fuel in the low-pressure chamber 220 is fed to the low-pressure rail 31 through the low-pressure fuel pipe 300. Each of the low-pressure fuel injection valves 32 supplies the fuel, which is stored in the low-pressure rail 31, to the engine according to the command of the control device 8.

The reciprocation of the plunger 27 is repeated in the high-pressure pump 20 at the time of supplying the low-pressure fuel from the low-pressure fuel injection valves 32 to the engine. However, at this time, since the fuel pressure control valve 25 is placed into the valve opening state, all of the fuel, which is suctioned into the pressurizing chamber 260 through the downward movement of the plunger 27, is returned to the suction flow passage 250 in response to the upward movement of the plunger 27. That is, the fuel in the leak chamber 240, the fuel in the suction flow passage 250, and the fuel in the pressurizing chamber 260 stay in the inside of the high-pressure pump 20. Therefore, depending on the environment, in which the high-pressure pump 20 is installed, the temperature of the fuel in the high-pressure pump 20 may be increased. Furthermore, in a case where this operational state continues, when the pressure of the fuel in the low-pressure chamber 220 is larger than the pressure of the fuel in the leak chamber 240, the fuel is supplied from the low-pressure chamber 220 to the leak chamber 240. Thereby, the pressure of the fuel in the leak chamber 240 is temporarily increased. When the pressure of the fuel in the leak chamber 240 is increased to or beyond a pressure that is obtained by subtracting the valve opening pressure of the suction check valve 23 from the pressure of the fuel in the low-pressure chamber 220, the valve closing state of the suction check valve 23 is maintained. Thereby, the fuel in the leak chamber 240, the fuel in the suction flow passage 250 and the fuel in the pressurizing chamber 260 stay in the inside of the high-pressure pump 20.

(a) In the high-pressure pump 20 of the first embodiment, a portion of the low-pressure fuel, which is introduced into the high-pressure pump 20, is suctioned into the pressurizing chamber 260 through the leak chamber 240 and the suction flow passage 250 and is pressurized in the pressurizing chamber 260. The high-pressure fuel, which is the fuel pressurized at the pressurizing chamber 260, is supplied to the high-pressure fuel supply device 40 through the outlet port 290. At this time, a portion of the fuel of the pressurizing chamber 260 flows into the leak chamber 240 through the gap between the outer wall 271 of the plunger 27 and the inner wall 261 of the pressurizing portion 26. Since the leaked fuel has been moved from the pressurizing chamber 260, which has the high pressure, to the leak chamber 240, which has the low pressure, the temperature of the leaked fuel becomes very high at the time when the leaked fuel leaks into the leak chamber 240. Specifically, in the case where the pressure of the fuel in the pressurizing chamber 260 is 20 MPa, and the pressure in the leak chamber 240 is 0.4 Mpa, the temperature of the leaked fuel is increased by about 10 degrees Celsius. Furthermore, as discussed above, in the case where the pressure of the fuel in the pressurizing chamber 260 is 80 MPa, and the pressure of the leak chamber 240 is 0.4 MPa, the temperature of the leaked fuel is increased by about 30 degrees Celsius. That is, when the pressure of the pressurizing chamber 260 is increased, the temperature of the leaked fuel is increased. When the leaked fuel, which has the high temperature, stays in the leak chamber 240 for a long period of time, the temperature of the high-pressure pump 20 is increased to possibly cause evaporation of the fuel in the gap between the plunger 27 and the pressurizing portion 26. When the fuel in the gap between the plunger 27 and the pressurizing portion 26 is evaporated, smooth slide movement between the plunger 27 and the pressurizing portion 26 becomes difficult to possibly cause seizing of the plunger 27.

In view of the above point, in the high-pressure pump 20 of the first embodiment, the leaked fuel, which is leaked into the leak chamber 240 and has the high temperature, is reliably discharged from the leak chamber 240 by the low-pressure fuel, which flows from the low-pressure chamber 220 toward the suction flow passage 250. The fuel, which is a mixture of the low-pressure fuel discharged from the leak chamber 240 and the leaked fuel, is pressurized in the pressurizing chamber 260 and is guided to the outside of the high-pressure pump 20. That is, in the high-pressure pump 20, the leaked fuel having the high temperature is flown in one direction along with the fuel suctioned into the pressurizing chamber 260, so that all of the leaked fuel is discharged from the high-pressure pump 20. In this way, the increase of the temperature of the high-pressure pump 20 is limited by limiting the long stay of the leaked fuel having the high temperature in the high-pressure pump 20, so that the evaporation of the fuel between the plunger 27 and the pressurizing portion 26 can be limited. As a result, smooth slide movement between the plunger 27 and the pressurizing portion 26 can be ensured, and thereby the seizing of the plunger 27 can be limited.

(b) In the high-pressure pump 20, at the time of supplying the fuel from the low-pressure fuel injection valves 32 to the engine, the flow of the fuel from the low-pressure chamber 220 to the pressurizing chamber 260 through the leak chamber 240 and the suction flow passage 250 does not occur. At this time, depending on the environment, in which the high-pressure pump 20 is placed, the temperature of the fuel in the leak chamber 240 and the suction flow passage 250 may possibly be increased. However, although the suction check valve 23 enables the flow of the fuel from the low-pressure chamber 220 side to the leak chamber 240 side, the suction check valve 23 blocks the flow of the fuel from the leak chamber 240 side to the low-pressure chamber 220 side. Thus, the pressure of the fuel in the leak chamber 240 is not excessively decreased. Therefore, even when the temperature of the fuel in the leak chamber 240 and the suction flow passage 250 becomes high, the fuel is not evaporated. Thereby, at the time of supplying the fuel from the low-pressure fuel injection valves 32 to the engine, it is possible to limit the evaporation of the fuel located between the plunger 27 and the pressurizing portion 26. As a result, smooth slide movement between the pressurizing portion 26 and the plunger 27 can be ensured, and thereby the seizing of the plunger 27 can be limited.

(c) In general, unlike the high-pressure fuel supply device, the low-pressure fuel supply device does not have a pressure sensor, which senses a pressure of the fuel in the low-pressure rail. Therefore, when the temperature and/or the pressure of the fuel stored in the low-pressure rail are/is changed, fuel injection characteristics of the low-pressure fuel injection valves may possibly be changed. In the fuel-supply system recited in the patent literature 1, the fuel, which is discharged from the low-pressure pump, is first guided into the leak chamber, and thereafter a portion of this fuel is supplied to the low-pressure fuel injection valves. Therefore, the leaked fuel in the leak chamber can be entirely discharged to the outside of the high-pressure pump. However, the fuel, into which the leaked fuel having the high temperature is mixed, is supplied to the low-pressure fuel injection valves. Therefore, the injection characteristics of the low-pressure fuel injection valves may possibly be changed.

The fuel-supply system 1 of the first embodiment is constructed such that the low-pressure fuel, which is stored in the low-pressure chamber 220, is fed to the low-pressure fuel supply device 30. Since the suction check valve 23, which blocks the flow of the fuel from the leak chamber 240 side to the low-pressure chamber 220 side, is placed between the low-pressure chamber 220 and the leak chamber 240, the leaked fuel having the high temperature does not flow into the low-pressure chamber 220. In this way, in the low-pressure chamber 220, the fuel of the low-pressure chamber 220 and the leaked fuel will not be mixed with each other. Thus, the fuel, which has the stable temperature and the stable pressure, can be fed to the low-pressure fuel supply device 30. Thereby, it is possible to limit the change of the injection characteristics of the low-pressure fuel injection valves 32.

(d) In the fuel-supply system 1 of the first embodiment, there is set such that the pressure, which is obtained by subtracting the valve opening pressure of the suction check valve 23 from the pressure of the fuel discharged from the low-pressure pump 10, is equal to or larger than the saturated vapor pressure of the fuel. In the case where the pressure of the fuel in the leak chamber 240 is equal to or smaller than the saturated vapor pressure, the suction check valve 23 is opened. Thereby, the fuel is supplied from the low-pressure chamber 220 to the leak chamber 240, and the pressure of the fuel in the leak chamber 240 is increased to the saturated vapor pressure or larger. In this way, it is possible to limit the evaporation of the fuel in the leak chamber 240. As a result, smooth slide movement between the pressurizing portion 26 and the plunger 27 can be ensured, and thereby the seizing of the plunger 27 can be limited.

(e) The low-pressure chamber pulsation damper 221, which damps the pressure pulsation of the fuel in the low-pressure chamber 220, is placed in the low-pressure chamber 220. Thereby, the change of the injection characteristics of the low-pressure fuel injection valve 32 can be limited.

(f) The relief valve 291 is installed in the high-pressure pump 20, and this relief valve 291 opens when the pressure of the fuel in the portion of the fifth connection pipe 205 located between the discharge valve 28 and the outlet portion 29 becomes equal to or larger than the second pressure. Thereby, the high-pressure fuel of the high-pressure fuel pipe 400 and the high-pressure rail 41, which is further pressurized by the high-pressure fuel fed from the pressurizing chamber 260 due to absence of injection of the fuel caused by, for example, a damage of the high-pressure fuel injection valve(s) 42, can be returned to the leak chamber 240 to limit a damage of the high-pressure fuel pipe 400 and the high-pressure rail 41.

(g) In general, the fuel pipe 12, which is connected to the low-pressure pump 10, is made of the material, such as the rubber, which has low heat resistance and low pressure resistance. When the high-pressure fuel, which is pressurized at the pressurizing chamber 260, or the leaked fuel having the high temperature, is conducted through the fuel pipe 12, the fuel pipe 12 may possibly be damaged. In the fuel-supply system 1 of the first embodiment, the suction check valve 23 is installed in the second connection pipe 202 to limit backflow of the fuel from the pressurizing chamber 260 or the leak chamber 240 into the fuel pipe 12. In this way, it is possible to limit a damage of the fuel pipe 12, which conducts the low-pressure fuel.

Second Embodiment

Next, a high-pressure pump according to a second embodiment of the present disclosure will be described. The second embodiment differs from the first embodiment with respect to the location of the pulsation damper, which damps the pressure pulsation of the fuel. In the following discussion, the portions, which are the same as those of the first embodiment, will be indicated by the same reference signs and will not be described redundantly for the sake of simplicity.

Figure 2:
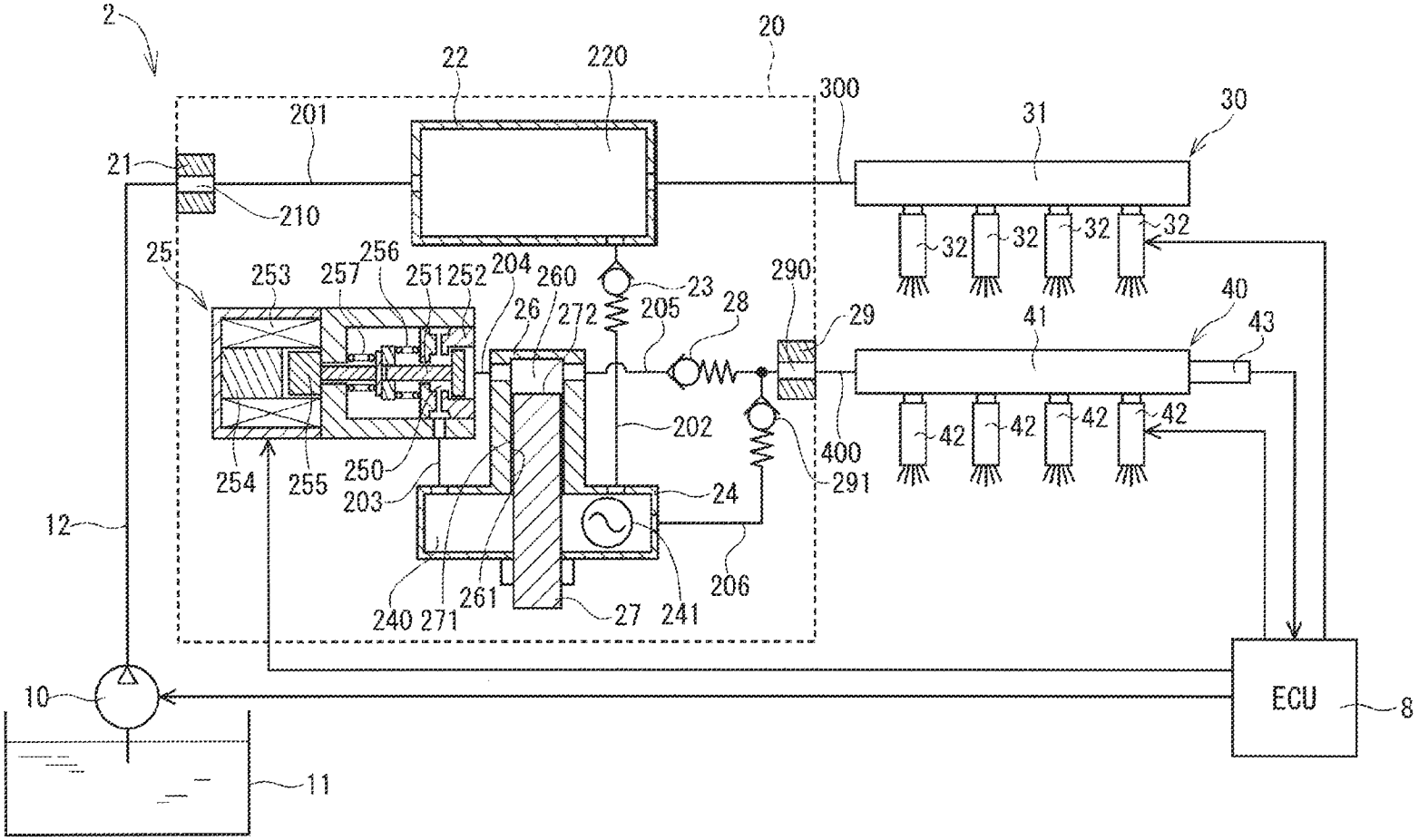
FIG. 2 is a schematic diagram of a fuel-supply system according to a second embodiment of the present disclosure.

FIG. 2 is a schematic diagram of a fuel-supply system 2 according to the second embodiment. The fuel-supply system 2 is a fuel-supply system that is applicable even in a case where a certain amount of pressure fluctuation of the fuel in the low-pressure rail 31 caused by, for example, pressure pulsation of the low-pressure pump 10 and/or a pressure decrease caused by the fuel injection at the low-pressure fuel injection valve 32 is allowed.

In the fuel-supply system 2, a leak chamber pulsation damper 241 is installed in the leak chamber 240. The leak chamber pulsation damper 241 damps the pressure pulsation of the fuel in the leak chamber 240.

In the fuel-supply system 2, the pressure of the fuel in the suction flow passage 250 and the leak chamber 240 is changed by the fuel that is inputted into or outputted from the pressurizing chamber 260. Due to this pressure change, there is a possibility of that the sufficient amount of fuel cannot be stably supplied to the pressurizing chamber 260.

In the fuel-supply system 2, the leak chamber pulsation damper 241 is placed in the leak chamber 240 to damp the pressure pulsation of the fuel in the suction flow passage 250 and the leak chamber 240. In this way, the second embodiment can achieve the advantages (a) to (d), (f) and (g) of the first embodiment and can limit the change of the injection characteristics of the high-pressure fuel injection valves 42 caused by the pressure pulsation of the fuel.

Third Embodiment

Next, a fuel-supply system according to a third embodiment of the present disclosure will be described with reference to FIG. 3. The third embodiment differs from the first embodiment with respect to the location of the low-pressure fuel pipe. In the following discussion, the portions, which are the same as those of the first embodiment, will be indicated by the same reference signs and will not be described redundantly for the sake of simplicity.

Figure 3:
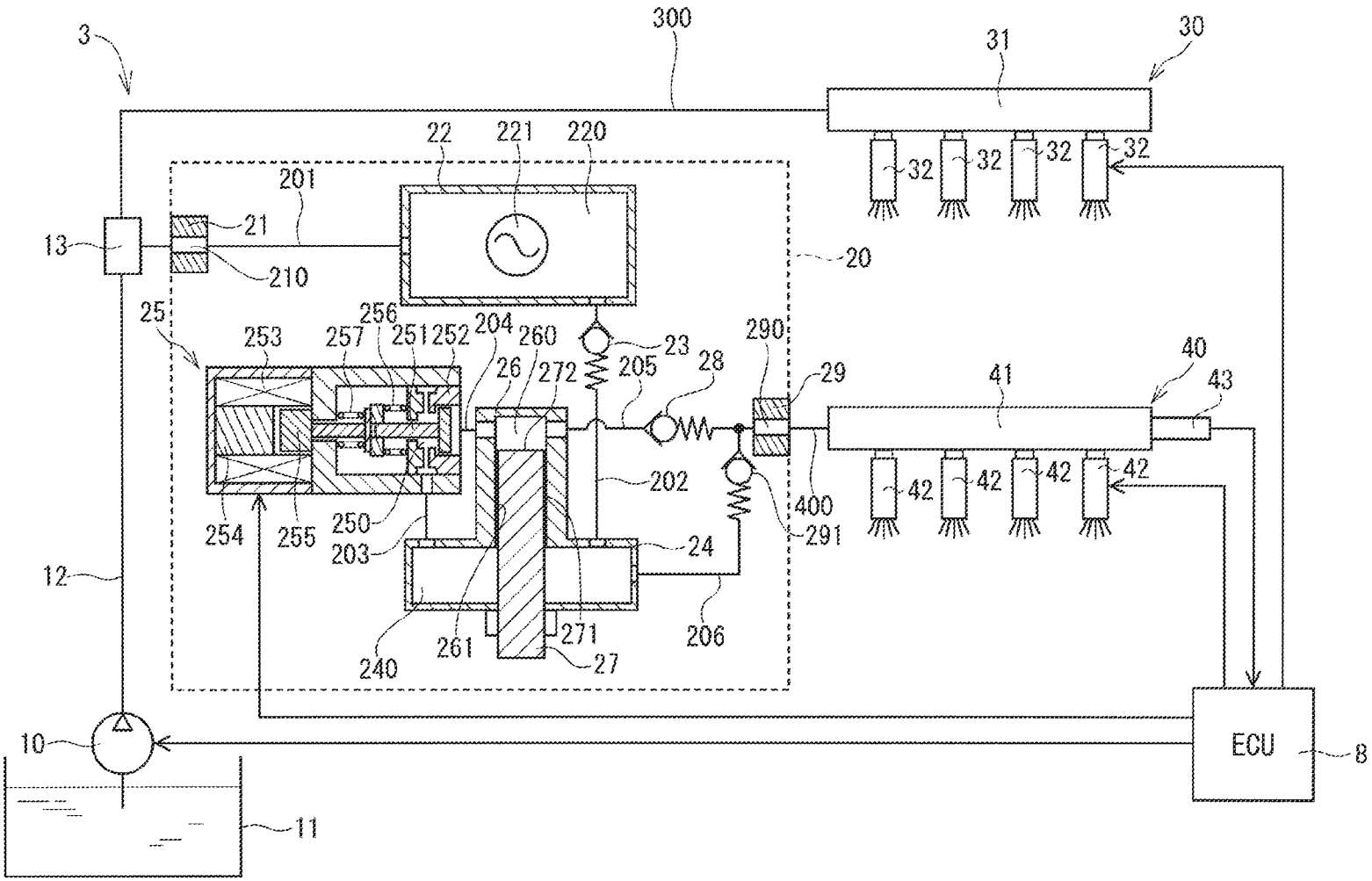
FIG. 3 is a schematic diagram of a fuel-supply system according to a third embodiment of the present disclosure.

FIG. 3 is a schematic diagram of a fuel-supply system 3 according to the third embodiment. The fuel-supply system 3 is a fuel-supply system that is applicable even in a case where the pipe, which supplies the fuel to the low-pressure fuel supply device 30, cannot be branched from the high-pressure pump 20 due to, for example, a restriction in terms of space availability.

In the fuel-supply system 3, a flow branching portion 13 is placed in the fuel pipe 12. The flow branching portion 13 is connected to the low-pressure fuel supply device 30 through the low-pressure fuel pipe 300.

In the fuel-supply system 3, the low-pressure fuel, which is pumped from the low-pressure pump 10, is branched at the flow branching portion 13. A portion of the low-pressure fuel, which is pumped by the low-pressure pump 10, is fed to the low-pressure fuel supply device 30 through the low-pressure fuel pipe 300. Furthermore, the rest of the low-pressure fuel in the flow branching portion 13, which is other than the fuel fed from the flow branching portion 13 to the low-pressure fuel supply device 30, is inputted into the inside of the high-pressure pump 20 through the inlet portion 21.

In the fuel-supply system 3 of the third embodiment, the low-pressure fuel is fed to the low-pressure fuel supply device 30 through the flow branching portion 13 without passing through the high-pressure pump 20.

In the high-pressure pump 20, the leaked fuel, which flows into the leak chamber 240, is reliably discharged from the high-pressure pump 20 along with the low-pressure fuel that is directed from the low-pressure chamber 220 to the suction flow passage 250 through the leak chamber 240. Furthermore, at the time of supplying the fuel from the low-pressure fuel injection valves 32 to the engine, the flow of the fuel from the leak chamber 240 to the low-pressure chamber 220 is blocked by the suction check valve 23. Thereby, the third embodiment can achieve the advantages (a) to (d), (f) and (g) of the first embodiment.

Fourth Embodiment

Next, a fourth embodiment of the present disclosure will be described with reference to FIG. 4. The fourth embodiment differs from the third embodiment with respect to the location of the suction check valve. In the following discussion, the portions, which are the same as those of the third embodiment, will be indicated by the same reference signs and will not be described redundantly for the sake of simplicity.

Figure 4:
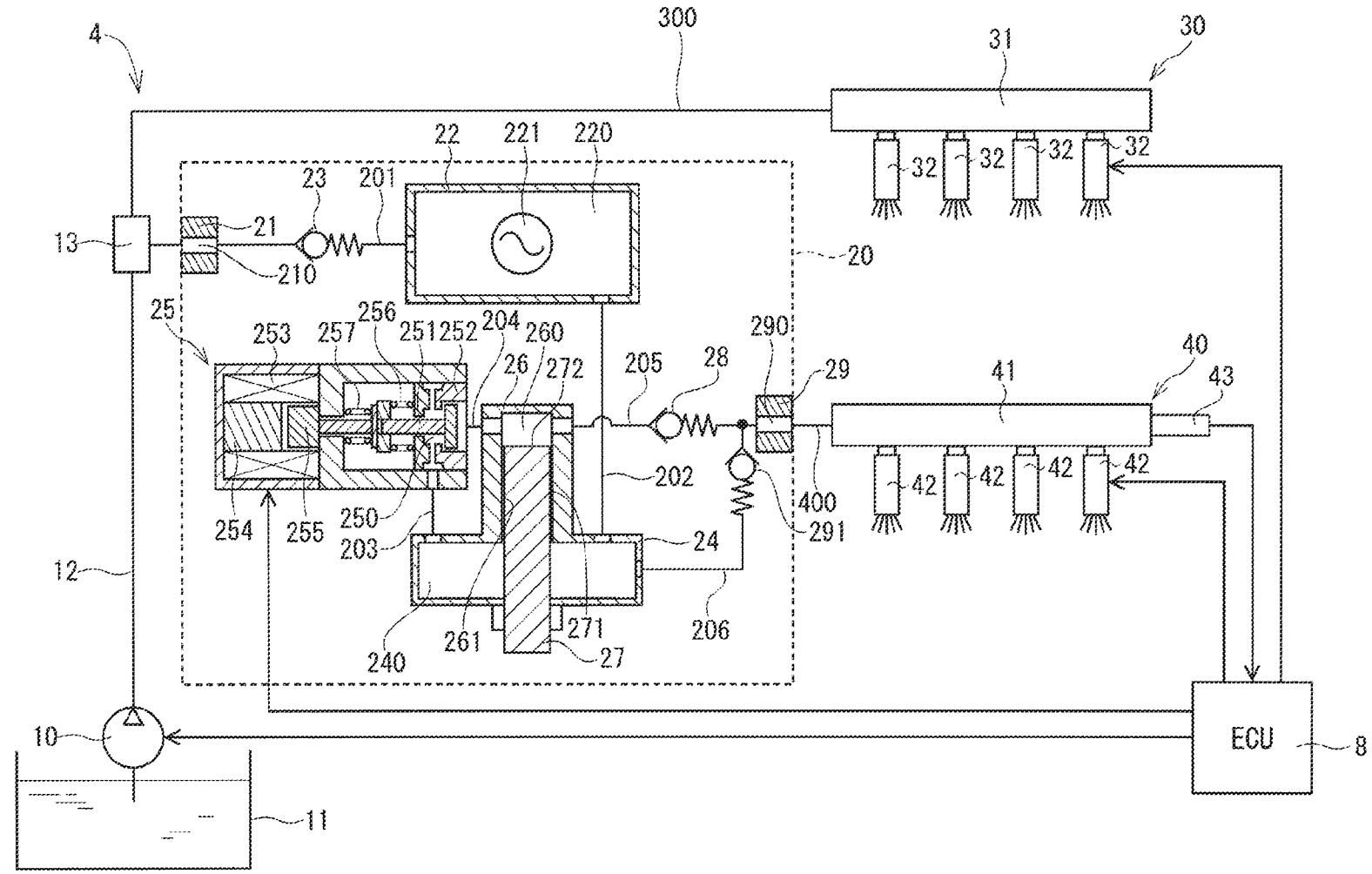
FIG. 4 is a schematic diagram of a fuel-supply system according to a fourth embodiment of the present disclosure.

FIG. 4 is a schematic diagram of a fuel-supply system 4 according to the fourth embodiment. The fuel-supply system 4 is a fuel-supply system that is applicable even in a case where a certain amount of pressure fluctuation of the fuel in the low-pressure rail 31 is allowed. In the fuel-supply system 4, the suction check valve 23 is placed in the first connection pipe 201.

In the fuel-supply system 4, the suction check valve 23 blocks a flow of the leaked fuel, which is conducted to the leak chamber 240, to the flow branching portion 13. Thereby, input of the leaked fuel having the high temperature into the low-pressure fuel supply device 30 can be limited. Thus, the fourth embodiment can achieve the advantages (a) to (d), (f) and (g) of the first embodiment.

Fifth Embodiment

Next, a fuel-supply system according to a fifth embodiment of the present disclosure will be described with reference to FIG. 5. The fifth embodiment differs from the fourth embodiment with respect to the location of the relief valve. In the following discussion, the portions, which are the same as those of the fourth embodiment, will be indicated by the same reference signs and will not be described redundantly for the sake of simplicity.

Figure 5:
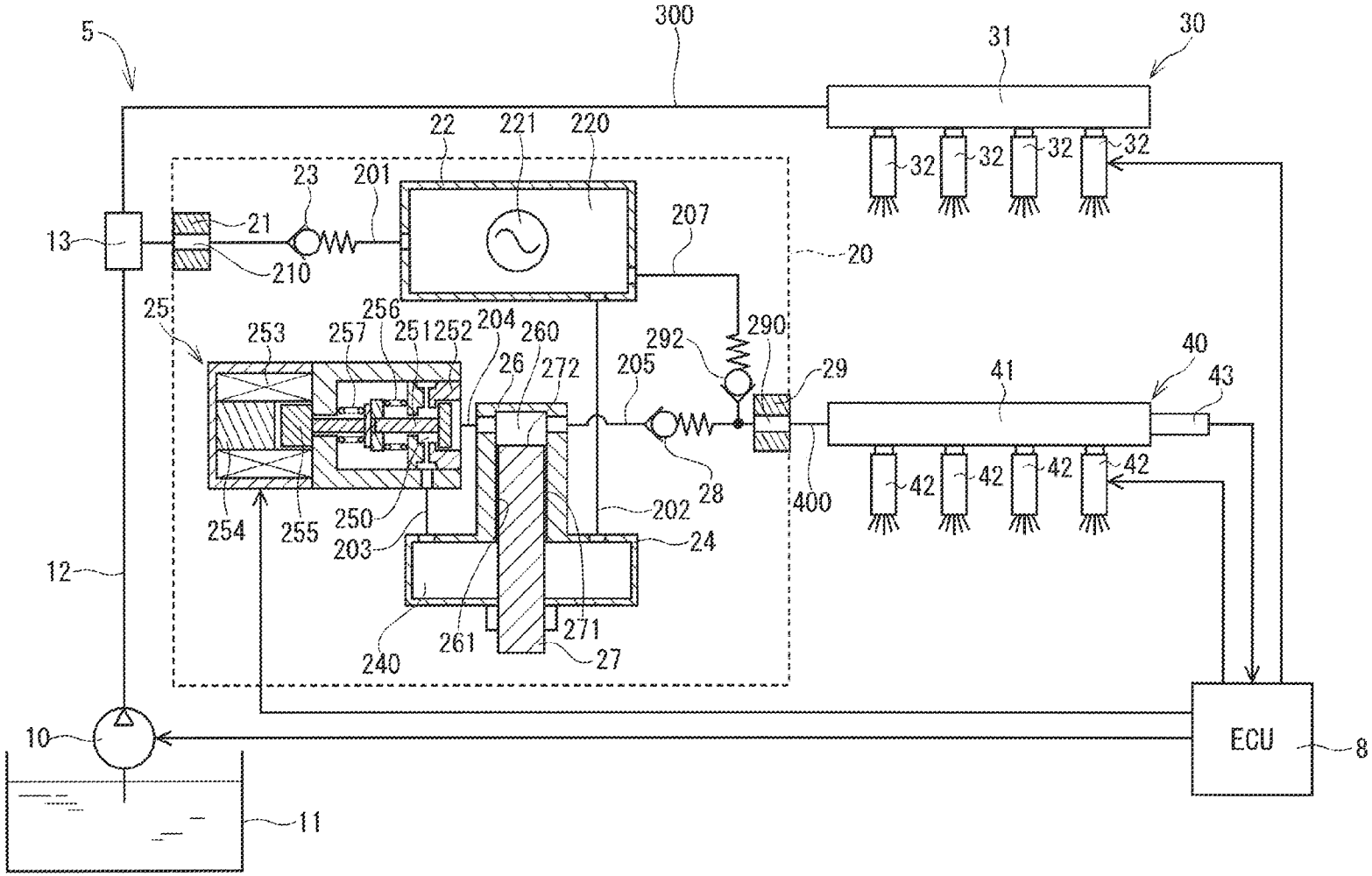
FIG. 5 is a schematic diagram of a fuel-supply system according to a fifth embodiment of the present disclosure.

FIG. 5 is a schematic diagram of a fuel-supply system 5 according to the fifth embodiment. The fuel-supply system 5 is a fuel-supply system that is applicable even in a case where a certain amount of pressure fluctuation of the fuel in the low-pressure rail 31 is allowed.

The fuel-supply system 5 includes a seventh connection pipe 207. The seventh connection pipe 207 connects between the portion of the fifth connection pipe 205, which is located between the discharge valve 28 and the outlet portion 29, and the low-pressure portion 22. A relief valve 292 is placed in the seventh connection pipe 207. When the pressure of the fuel in the portion of the fifth connection pipe 205 located between the discharge valve 28 and the outlet portion 29 becomes equal to or larger than the second pressure, the relief valve 292 is opened, and thereby the fuel, which is located on the downstream side of the discharge valve 28, is returned to the low-pressure chamber 220 through the relief valve 292.

In the fuel-supply system 5 of the fifth embodiment, when the pressure of the fuel in the portion of the fifth connection pipe 205, which is located between the discharge valve 28 and the outlet portion 29, becomes equal to or larger than the second pressure, the relief valve 292 is opened, and thereby the fuel, which is located on the downstream side of the discharge valve 28, is returned to the low-pressure chamber 220 through the relief valve 292. Furthermore, the flow of the fuel from the low-pressure chamber 220 side to the inlet port 210 side is blocked by the suction check valve 23 that is placed between the inlet portion 21 and the low-pressure portion 22. Therefore, the leaked fuel does not flow into the low-pressure fuel supply device 30. Thereby, the fifth embodiment can achieve the advantages (a) to (d), (f) and (g) of the first embodiment.

Other Embodiments (1) In the above embodiments, the high-pressure pump is applied to the fuel-supply system that can supply the fuel of the two different pressures, i.e., the low pressure and the high pressure to the engine. However, the high-pressure pump of the present disclosure may be configured to supply the high-pressure fuel alone without being used in such a fuel-supply system.

(2) In the above embodiments, the high-pressure fuel injection valves are capable of supplying the fuel of the very high pressure, such as about 80 Mpa. However, the pressure of the fuel, which is injected by the high-pressure fuel injection valves, is not limited to this pressure. As the fuel-supply system, it is only required to supply the fuel of different pressures to the engine.

(3) In the above embodiments, the high-pressure pump includes the low-pressure chamber, in which the fuel is temporarily stored. However, the low-pressure chamber may be eliminated.

(4) In the above embodiments, there is set such that the pressure, which is obtained by subtracting the valve opening pressure of the suction check valve from the pressure of the fuel discharged from the low-pressure pump 10, is equal to or larger than the saturated vapor pressure of the fuel. However, the valve opening pressure of the suction check valve should not be limited to this.

(5) The pulsation damper is placed in the low-pressure portion or the leak fuel inflow portion in the above discussion. However, the pulsation damper may be placed in both of the low-pressure portion and the leak fuel inflow portion or may be eliminated from both of the low-pressure portion and the leak fuel inflow portion.

(6) In the above embodiments, when the relief valve is opened, the fuel, which is located on the downstream side of the discharge valve, is returned to the leak chamber or the low-pressure chamber. However, the location, to which the fuel is returned, should not be limited to this. The location, to which the fuel is returned, may be any location from the suction check valve to the discharge valve in the flow of the fuel.

The present disclosure should not be limited to the above embodiments and may be implemented in various other forms without departing from the scope of the present disclosure.

The invention claimed is:

1. A high-pressure pump comprising:

a plunger that is reciprocatable;

a pressurizing portion that reciprocatably receives the plunger and includes a pressurizing chamber, in which fuel is pressurized by the plunger, wherein the pressurizing portion has an inner wall, along which the plunger is slidable;

a leak fuel reservoir that includes a leak chamber, into which the fuel leaked from the pressurizing chamber flows through a gap between the plunger and the inner wall of the pressurizing portion, wherein the leak chamber is located on an opposite side of the inner wall of the pressurizing portion, the leak chamber is opposite from the pressurizing chamber in an axial direction of the plunger, and the plunger is partially exposed in an inside of the leak chamber;

a suction control valve that includes a suction flow passage, which communicates between the leak chamber and the pressurizing chamber, wherein the suction flow passage is connected to the leak chamber through a supply passage, which is located on a downstream side of the leak chamber in a flow direction of the fuel, and the suction control valve is operable to control a quantity of the fuel, which is suctioned into the pressurizing chamber through the suction flow passage;

a discharge valve that is opened to discharge the fuel from the pressurizing chamber to an outside of the pressurizing portion when a pressure of the fuel in the pressurizing chamber becomes equal to or larger than a first pressure;

an inlet that includes an inlet port, through which fuel of a fuel tank is guided into the leak chamber;

an outlet that includes an outlet port, through which the fuel discharged from the discharge valve is outputted to an outside of the high-pressure pump;

a low-pressure reservoir, which is located on a downstream side of the inlet port in a flow direction of the fuel and communicates between the inlet port and the leak chamber, wherein the low-pressure reservoir includes a low-pressure chamber, which stores the fuel received from the fuel tank; and a suction check valve that is installed in a one-way passage, which extends from the low-pressure reservoir to the leak chamber to supply the fuel from the low-pressure reservoir to the leak chamber, wherein the suction check valve is configured to enable flow of the fuel from the low-pressure reservoir side to the leak chamber side and block flow of the fuel from the leak chamber side to the low-pressure reservoir side, and the inlet port and the low-pressure reservoir are communicated with the leak chamber only through the one-way passage.

2. The high-pressure pump according to claim 1, wherein a valve opening pressure of the suction check valve is equal to or smaller than a pressure difference between a pressure of the fuel introduced from the inlet port and a saturated vapor pressure of the fuel, and the suction check valve enables the flow of the fuel from the inlet port to the leak chamber when a difference between the pressure of the fuel introduced from the inlet port and a pressure of the fuel in the leak chamber is equal to or larger than the valve opening pressure.

3. The high-pressure pump according to claim 1, further comprising a pulsation damper, which is placed in the low-pressure chamber and is operable to reduce pressure pulsation of the fuel in the low-pressure chamber.

4. The high-pressure pump according to claim 1, further comprising a pulsation damper, which is placed in the leak chamber and is operable to reduce pressure pulsation of the fuel in the leak chamber.

5. The high-pressure pump according to claim 1, further comprising a relief valve, which is opened to return the fuel located between the discharge valve and the outlet to an upstream side of the discharge valve when a pressure of the fuel located between the discharge valve and the outlet becomes equal to or larger than a second pressure, which is larger than the first pressure.

6. The high-pressure pump according to claim 5, wherein the relief valve opens to return the fuel located between the discharge valve and the outlet to a downstream side of the suction check valve when the pressure of the fuel located between the discharge valve and the outlet is equal to or larger than the second pressure.

7. A fuel-supply system for supplying fuel stored in the fuel tank to an internal combustion engine at a low pressure or a high pressure depending on an operational state of a vehicle, the fuel-supply system comprising:

a low-pressure pump that is operable to suction the fuel of the fuel tank and discharge the suctioned fuel;

a low-pressure fuel supply that supplies the fuel, which is discharged from the low-pressure pump, to the internal combustion engine;

the high-pressure pump of claim 1 that is operable to pressurize and discharge the fuel, which is discharged from the low-pressure pump; and a high-pressure fuel supply that supplies the fuel, which is discharged from the high-pressure pump, to the internal combustion engine.

8. The fuel-supply system according to claim 7, wherein the fuel located between the low-pressure pump and the suction check valve is supplied to the low-pressure fuel supply.

* * * * *